US012808077B2

(12) United States Patent
Kotani et al.

(10) Patent No.: US 12,808,077 B2
(45) Date of Patent: Nov. 24, 2026

(54) COMPOSITE MATERIAL, METHOD FOR MANUFACTURING COMPOSITE MATERIAL, TERMINAL AND METHOD FOR MANUFACTURING TERMINAL

(71) Applicant: DOWA METALTECH CO., LTD., Tokyo (JP)

(72) Inventors: Hirotaka Kotani, Tokyo (JP); Hiroto Narieda, Tokyo (JP); Takao Tomiya, Tokyo (JP); Tatsuhiro Doi, Tokyo (JP); Yukiya Kato, Tokyo (JP); Hirotaka Takahashi, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 0 days.

(21) Appl. No.: 18/563,521

(22) PCT Filed: Mar. 17, 2022

(86) PCT No.: PCT/JP2022/012392
§ 371 (c)(1),
(2) Date: Nov. 22, 2023

(87) PCT Pub. No.: WO2023/276324
PCT Pub. Date: Jan. 5, 2023

(65) Prior Publication Data

US 2024/0287699 A1 Aug. 29, 2024

(30) Foreign Application Priority Data

Jul. 2, 2021 (JP) ..... 2021-110463

(51) Int. Cl.
*C25D 5/48* (2006.01)
*C25D 5/12* (2006.01)
*C25D 7/00* (2006.01)
*C25D 15/00* (2006.01)

(52) U.S. Cl.
CPC ..... *C25D 5/48* (2013.01); *C25D 5/12* (2013.01); *C25D 7/00* (2013.01); *C25D 15/00* (2013.01); *Y10T 428/12896* (2015.01)

(58) Field of Classification Search
None
See application file for complete search history.

(56) References Cited

U.S. PATENT DOCUMENTS 3,385,677 A * 5/1968 Schreiner ..... H01B 1/00 419/21
4,374,311 A * 2/1983 Okahashi ..... H01H 1/023 428/673
2004/0202884 A1* 10/2004 Buresch ..... C23C 28/021 428/553
2006/0024430 A1* 2/2006 Yau ..... C23C 18/42 106/1.19
2007/0007497 A1 1/2007 Miyazawa et al.
2007/0116974 A1* 5/2007 Camel ..... C23C 14/0084 204/192.1
2008/0139058 A1* 6/2008 Oda ..... H01R 13/03 174/126.2
2010/0291303 A1* 11/2010 Abys ..... C23F 11/161 427/343
2011/0262293 A1* 10/2011 Heinzel ..... C22C 32/0084 419/5
2015/0243408 A1 8/2015 Shinohara et al.
2015/0292076 A1* 10/2015 Asada ..... C22C 5/04 118/723 VE
2017/0352972 A1* 12/2017 Kato ..... H01R 13/03
2022/0259753 A1 8/2022 Kotani et al.
2023/0097787 A1* 3/2023 Hirai ..... C23G 1/103 428/673

FOREIGN PATENT DOCUMENTS

EP 1788110 B1 7/2012
EP 2749673 A1 7/2014
JP H06-053380 A 2/1994
JP 2001/003194 A 1/2001
JP 2006-002205 A 1/2006
JP 2007-16250 A 1/2007
JP 2011-74499 A 4/2011
JP 6804597 B1 12/2020

OTHER PUBLICATIONS

ISR Issued International Patent Application No. PCT/JP2022/012392, Apr. 19, 2022, translation.
Written Opinion issued in International Patent Application No. PCT/JP2022/012392, Apr. 19, 2022, translation.
EESR Issued in European Patent Application No. 22832487.7, issued Jun. 5, 2025.
Yulin Zhou et al., "Usability of Silver Plating and Silver Bismuth Alloy Plating on Electrical Contacts" 2013 IEEE 59th Holm Conference on Electrical Contacts (Holm 2013), IEEE, Sep. 22, 2013 (Sep. 22, 2013), pp. 1-10, XP032520897, ISSN: 1062-6808, DOI: 10.1109/HOLM.2013.6651439, ISBN: 978-1-4799-1556-9, [retrieved on Oct. 31, 2013].

* cited by examiner

*Primary Examiner* — Seth Dumbris
(74) *Attorney, Agent, or Firm* — GREENBLUM & BERNSTEIN, P.L.C.

(57) ABSTRACT

There is provided a composite material in which an oxygen-containing silver-based coating layer is formed on a base material, the oxygen-containing silver-based coating layer containing silver and having oxygen present in the vicinity of its surface, and the base material comprising copper or copper alloy.

13 Claims, No Drawings

COMPOSITE MATERIAL, METHOD FOR MANUFACTURING COMPOSITE MATERIAL, TERMINAL AND METHOD FOR MANUFACTURING TERMINAL

BACKGROUND

Technical Field

The present invention relates to a composite material in which a predetermined coating layer is formed on a base material, a method for manufacturing the same, and the like, and particularly, relates to a composite material used as a material for a sliding contact part such as a connector and switch, and a method for manufacturing the same.

Description of Related Art

In recent years, in order to improve environmental performance, safety, comfort, etc. in a field of automobiles, electronic control of various functions is progressing.

An object to be controlled such as an automatic transmission or a sensor and an electronic control unit (ECU) are connected by a wire harness. The object to be controlled or the ECU and the wire harness are connected by a connector provided to each other.

As described above, electronic control of various functions is progressing, so the number of sensors etc., connected to the ECU is increasing, and therefore, the number of terminals constituting the connector is increasing (multipolarization). As the connector becomes multipolar, the force (insertion force) required to fit the (terminals of) the connectors together increases, thereby making manual fitting difficult. The insertion force F of the terminal basically has a relationship of $F=\mu N$, where N is a vertical load when fitting a male terminal and a female terminal, and $\mu$ is a coefficient of friction during insertion.

As described above, when the connector becomes multipolar, the insertion force increases, so the connector needs to be divided and a fitting aid (lever) is required, resulting in a large size of the connector and a high manufacturing cost of the connector.

Regarding this problem, since the number of terminals cannot be reduced, it is necessary to reduce the insertion force per set of terminals.

In addition to the above-described low insertion force, electrical conductivity is also required for sliding contact parts such as terminals used in the connector, and due to these required characteristics, copper (Cu) and copper alloys, which are excellent in electrical conductivity, are used as conductor materials for the components.

Since copper is easily oxidized, a tin (Sn)-plated material is used, which is a conductive material that is tin-plated with excellent oxidation resistance.

However, due to a vehicle vibration (vibration from a road surface, vibration from an engine, etc., during driving), tin plating is prone to microsliding wear, which raises an electrical resistance between contacts, resulting in poor conduction, and therefore the contact pressure (contact pressure) between terminals cannot be lowered, resulting in a large insertion force. The microsliding wear is a phenomenon in which the oxidation of tin between the contacts of the terminals is accelerated and a thick tin oxide is generated and deposited between the contacts of the terminals, due to repeated sliding several tens of micrometers at the contact. As described above, the contact pressure between terminals cannot be lowered by Sn plating, and therefore in order to secure a low insertion force, it is necessary to lower the coefficient of friction of Sn plating. As a means for lowering the coefficient of friction by Sn plating, it has been proposed to make a plated layer thinner, but the effect of lowering the coefficient of friction is about 10 to 20%, which is insufficient.

In contrast, silver (Ag) is very excellent in both oxidation resistance and electrical conductivity, and an Ag-plated material has a small electrical resistance even in a case of a small contact pressure of the terminals. In addition, since silver is excellent in heat resistance, the Ag-plated material is excellent in contact reliability (characteristics such as electrical conductivity are less likely to deteriorate even when heat is applied).

However, the Ag-plated material causes a phenomenon of silver adhesion during insertion/extraction (sliding), so the coefficient of friction of the Ag-plated material is relatively high. Therefore, in order to lower the coefficient of friction of the Ag-plated material, there is proposed a method for improving wear resistance by forming a composite film in which graphite particles among carbon particles such as graphite and carbon black, which are excellent in wear resistance and lubricity, are dispersed in a silver matrix, on a conductor material by electroplating (see Patent Documents 1 and 2, for example).

Specifically, Patent Documents 1 and 2 disclose a composite material in which a composite film containing carbon particles in a silver layer, is formed on a base material, by electroplating using a silver plating solution in which carbon particles from which surface lipophilic organic matters have been removed by oxidation and a silver matrix alignment modifier (potassium selenocyanate) are added.

In addition, Patent Document 3 discloses a lead frame including: a die pad on which electronic circuit elements are mounted, inner leads wire-bonded to a bonding pad of the electronic circuit elements, and outer leads formed integrally with the inner leads, with at least tips plated with a metal such as silver and gold, etc., in which at least the metal-plated portion is subjected to hydrophilic treatment (oxygen-plasma treatment).

PRIOR ART DOCUMENT

Patent Document

[Patent Document 1] JP-A-2007-16250
[Patent Document 2] JP-A-2011-074499
[Patent Document 3] JP-A-H6-53380

SUMMARY OF THE INVENTION

Problem to be Solved by the Invention

A conventional silver (Ag)-plated material, which is a silver-plated conductor material used in sliding contact parts, have an advantage of excellent electrical conductivity, oxidation resistance, and contact reliability, but its coefficient of friction is relatively high, and applications that can be used are limited. When the insertion force can be reduced by reducing this coefficient of friction, it is expected that the applications will expand.

Further, in the composite material disclosed in Patent Documents 1 and 2 in which a composite film having graphite particles dispersed in a silver matrix, a portion of a surface of the composite coating film where the graphite particles are not exposed is silver. As in the case of Ag plating, this silver adheres when the composite material slides on a mating material. Therefore, although this composite material also has a lower coefficient of friction than silver plating that does not contain graphite particles, it does not fully meet the recent state-of-the-art requirement of low insertion force.

Accordingly, an object of the present invention is to provide a material for sliding contact parts having a coefficient of friction lower than that of a conventional material.

Means for Solving the Problem

As a result of intensive research by the present inventors to solve the above problems, it is found that by plasma-treating the surface of the silver-plated layer or the composite film (coating layer) containing carbon particles in the silver layer in the presence of oxygen so that oxygen exists in the vicinity of the surface, the coefficient of friction of the material for the sliding contact part can be reduced. Thus, the present invention is completed.

That is, the present invention is as follows.

[1] A composite material in which an oxygen-containing silver-based coating layer is formed on a base material, the oxygen-containing silver-based coating layer containing silver and having oxygen present in the vicinity of its surface, and the base material comprising copper or copper alloy.

[2] The composite material according to [1], which is used for terminal applications.

[3] The composite material according to [1] or [2], wherein the oxygen-containing silver-based coating layer contains carbon particles.

[4] The composite material according to any one of [1] to [3], wherein an underlying layer comprising nickel is formed between the base material and the oxygen-containing silver-based coating layer.

[5] The composite material according to any one of [1] to [4], wherein EDS analysis for the surface of the oxygen-containing silver-based coating layer reveals that an amount of oxygen is 1% by mass or more with respect to 100% by mass of a total amount of all detected elements.

[6] The composite material according to any one of [1] to [5], wherein

EDS analysis for the surface of the oxygen-containing silver-based coating layer reveals that a total amount of silver, oxygen, carbon, antimony and tin is 99% by mass or more with respect to 100% by mass of a total amount of all detected elements, and an amount of oxygen is 1 part by mass or more with respect to 100 parts by mass of the total amount of silver, oxygen, carbon, antimony and tin.

[7] The composite material according to [6], wherein a total amount of silver and carbon is 88 parts by mass or more with respect to 100 parts by mass of the total amount of silver, oxygen, carbon, antimony and tin.

[8] The composite material according to [6] or [7], wherein an amount of oxygen is 1.1 to 12 parts by mass with respect to 100 parts by mass of the total amount of silver, oxygen, carbon, antimony and tin.

[9] A terminal comprising a composite material in which an oxygen-containing silver-based coating layer is formed on a base material, the oxygen-containing silver-based coating layer containing silver and having oxygen present in the vicinity of its surface, and the base material comprising copper or copper alloy.

[10] The terminal according to [9], wherein the oxygen-containing silver-based coating layer contains carbon particles.

[11] The terminal according to [9] or [10], wherein EDS analysis for the surface of the oxygen-containing silver-based coating layer reveals that an amount of oxygen is 1% by mass or more with respect to 100% by mass of a total amount of all detected elements.

[12] The terminal according to any one of [9] to [11], wherein EDS analysis for the surface of the oxygen-containing silver-based coating layer reveals that a total amount of silver, oxygen, carbon, antimony and tin is 99% by mass or more with respect to 100% by mass of a total amount of all detected elements, and an amount of oxygen is 1 part by mass or more with respect to 100 parts by mass of the total amount of silver, oxygen, carbon, antimony and tin.

[13] A method for manufacturing a composite material, including:

forming an oxygen-containing silver-based coating layer by applying plasma treatment under a presence of oxygen to a surface of a coating layer in a laminated material in which the coating layer containing silver is formed on a base material comprising copper or copper alloy.

[14] The method for manufacturing a composite material according to [13], wherein a gas containing oxygen is used as a plasma gas in the plasma treatment.

[15] The method for manufacturing a composite material according to [14], wherein the plasma gas contains 1 to 20% by volume of oxygen with a balance being a non-oxidizing element.

[16] A method for manufacturing a terminal, including:

molding the composite material according to any one of [1] to [8] into a terminal shape.

Advantage of the Invention

According to the present invention, there is provided a material for sliding contact parts with a coefficient of friction more reduced than a conventional material.

DETAILED DESCRIPTION OF THE INVENTION

Embodiments of the present invention will be described hereafter.

[Composite Material]

An embodiment of the composite material of the present invention will be described below. The composite material is the material in which an oxygen-containing silver-based coating layer is formed on a base material, the oxygen-containing silver-based coating layer containing silver and having oxygen present in the vicinity of its surface, and the base material comprising copper or copper alloy. This composite material can be manufactured, for example, by a method for manufacturing a composite material according to the present invention, which will be described later. Each configuration of this composite material will be described below.

<<Base Material>>

As a constituent material of the base material on which the oxygen-containing silver-based coating layer is formed, a material that can be silver-plated and has conductivity required for materials for, e.g., sliding contact parts such as connectors and switches, is suitable, and further, from a viewpoint of a cost, Cu (copper) and Cu alloy are employed in the present invention. As the Cu alloy, an alloy comprising Cu and at least one selected from a group consisting of Si (silicon), Fe (iron), Mg (magnesium), P (phosphorus), Ni (nickel), Sn (tin), Co (cobalt), Zn (zinc), Be (beryllium), Pb (lead), Te (tellurium), Ag (silver), Zr (zirconium), Cr (chromium), Al (aluminum), and Ti (titanium), and inevitable impurities, is preferable from a viewpoint of compatibility between conductivity and wear resistance.

An amount of Cu in the Cu alloy is preferably 50% by mass or more, more preferably 85% by mass or more, and still more preferably 92% by mass or more. The amount of Cu is preferably 99.95 mass % or less. In the case of so-called brass in which the copper alloy contains 20% by mass or more of Zn, the amount of Cu is preferably 50% by mass or more, more preferably 55% by mass or more, and still more preferably 60% by mass or more. The amount of Cu is preferably 79 mass % or less.

As described later, the base material is preferably used for terminals (as a composite material in which an oxygen-containing silver-based coating layer is formed), and in some cases, the base material itself has such a shape, or in other cases, the base material has a flat shape (such as a flat plate shape) and is formed into a shape for applications after being made into a composite material, and in some cases, it is molded at the stage of a laminated material in the method for manufacturing the composite material of the present invention, which will be described later. The flat plate shape is a rectangular parallelepiped shape with a low height, and more specifically, it is the shape with a height of 0.1 to 5 when a length of a shorter one (a short side) of the vertical and horizontal sides is 100 (vertical and horizontal sides may be the same). Two surfaces formed by the vertical and horizontal sides are called plate surfaces.

Regarding a long side and a short side (both lengths may be the same) of the flat plate surface, the length of the short side is, for example, 10 mm to 300 mm, and the length of the long side is, for example, 15 mm or more. Also, the height is, for example, 3 mm or less, and usually 0.1 mm or more.

<<Oxygen-Containing Silver-Based Coating Layer>>

The oxygen-containing silver-based coating layer formed on the base material contains silver. When Ag strike plating is applied to the base material before forming the oxygen-containing silver-based coating layer, there is an intermediate layer by this strike plating between the base material (or an underlying layer described later) and the oxygen-containing silver-based coating layer, but this intermediate layer is often so thin that it is indistinguishable from the oxygen-containing silver-based coating layer. Further, the oxygen-containing silver-based coating layer may be formed on an entire surface layer of the base material, or may be formed on a part of the surface layer.

From the viewpoint of conductivity and low coefficient of friction, examples of the oxygen-containing silver-based coating layer include: Ag layer comprising silver (Ag), AgSb alloy layer comprising silver-antimony alloy (AgSb alloy), AgSn alloy layer comprising silver-tin alloy (AgSn alloy), and AgC composite layer, AgSbC composite layer and AgSnC composite layer containing carbon particles in the above layers, with oxygen present in the vicinity of the surfaces of these layers (hereafter, these are also referred to as, for example, "oxygen-containing Ag layer", "oxygen-containing AgSn alloy layer", and "oxygen-containing AgC composite layer"). Among these layers, the oxygen-containing Ag layer and the oxygen-containing AgC composite layer are preferable because they are excellent in heat resistance and conductivity, and further, the oxygen-containing AgC composite layer is particularly preferable because of its particularly low coefficient of friction.

In the oxygen-containing AgC composite layer, the oxygen-containing AgSbC composite layer and the oxygen-containing AgSnC composite layer, carbon particles are preferably dispersed substantially uniformly in a matrix of silver, AgSb alloy or AgSn alloy. A typical method of forming these composite layers is electroplating. However, when a plated film is formed on the base material by electroplating, the carbon particles are entangled in the matrix of silver, AgSb alloy or AgSn alloy. When the oxygen-containing silver-based coating layer contains carbon particles, the wear resistance of the composite material increases. From a viewpoint of exhibiting such a function, the carbon particles are preferably graphite particles. The shape of the carbon particles is not particularly limited, and may be approximately spherical, scale-shaped, amorphous, or the like. The scale-shaped carbon particle is preferable because it is easily entangled in the matrix of silver or the like. Further, an average primary particle size of the carbon particles is preferably 0.5 to 15 μm, more preferably 1 to 10 μm, from a viewpoint of the wear resistance of (the composite layer of) the composite material. The average primary particle size is an average value of a long diameter of the particles, and the long diameter is a length of a longest line segment that can be drawn inside a particle and does not go outside a particle contour, in an image (plane) of the carbon particles in the composite layer (oxygen-containing silver-based coating layer) of the composite material observed at an appropriate magnification. Further, the long diameter is obtained for 50 or more particles.

<<Oxygen in the Vicinity of the Surface of the Oxygen-Containing Silver-Based Coating Layer>>

In the composite material of the present invention, there is a presence of oxygen in the vicinity of the surface of the oxygen-containing silver-based coating layer. The vicinity of the surface is the vicinity of the surface of the coating layer exposed to outside, and opposite to the surface in contact with the base material (interposing the underlying layer if the underlying layer exists, which will be described later). The presence of oxygen in the vicinity of the surface is considered to contribute to the low coefficient of friction of the composite material. The inventors presume the mechanism as follows.

oxygen chemically bonds with silver in the vicinity of the surface of the oxygen-containing silver-based coating layer to form silver oxide, and as a result, at least a part of the surface of the oxygen-containing silver-based coating layer comprises silver oxide. The silver oxide is very resistant to adhesion that is a problem in the case of silver due to friction with the mating material of the composite material. It is considered that this is the reason why the coefficient of friction of the composite material is lowered.

Oxygen in the vicinity of the surface of the oxygen-containing silver-based coating layer can be detected and quantified by EDS (energy dispersive X-ray spectroscopy). A specific method of EDS will be described in examples below. When EDS analysis for the surface of the oxygen-containing silver-based coating layer is performed, an amount of oxygen is preferably 1% by mass or more with respect to 100% by mass of a total amount of all detected elements, from a viewpoint of lowering the coefficient of friction. Further, too much oxygen may reduce the electrical conductivity of the composite material. From the viewpoint of the coefficient of friction and conductivity, an amount of oxygen is more preferably 1.1 to 12% by mass, still more preferably 1.6 to 10% by mass, and particularly preferably 5 to 8% by mass with respect to 100% by mass of the total amount.

<<Constituent Elements of the Oxygen-Containing Silver-Based Coating Layer>>

As described above, examples of the oxygen-containing silver-based coating layers include: oxygen-containing Ag layer, oxygen-containing AgSb alloy layer, oxygen-containing AgSn alloy layer, oxygen-containing AgC composite layer, oxygen-containing AgSbC composite layer and oxygen-containing AgSnC composite layer.

When the oxygen-containing silver-based coating layer is any of these layers, EDS analysis for the surface of the oxygen-containing silver-based coating layer reveals that a total amount of silver, oxygen, carbon, antimony and tin is 99% by mass or more, with respect to 100% by mass of a total amount of all detected elements, and an amount (mass) of oxygen is 1 part by mass or more with respect to 100 parts by mass of a total amount of silver, oxygen, carbon, antimony and tin. From a viewpoint of lowering the coefficient of friction of the composite material and since the conductivity of the composite material may decrease if the oxygen content is excessively high, the amount of oxygen is preferably 1.1 to 12 parts by mass, more preferably 1.6 to 10 parts by mass, particularly preferably 5 to 8 parts by mass, with respect to 100 parts by mass of the total amount of silver, oxygen, carbon, antimony and tin.

When the oxygen-containing silver-based coating layer is an oxygen-containing AgC composite layer, a total amount (mass) of silver, carbon and oxygen is usually 99.5 parts by mass or more, with respect to 100 parts by mass of a total amount of silver, oxygen, carbon, antimony and tin. Further, a total amount of silver and carbon is preferably 88 parts by mass or more with respect to 100 parts by mass of the total amount. From a viewpoint of electrical conductivity and coefficient of friction, a total amount of silver and carbon is more preferably 90 to 98.4 parts by mass. From a similar viewpoint, an amount of carbon is preferably 3 to 30 parts by mass, more preferably 4 to 20 parts by mass, with respect to 100 parts by mass of the total amount of silver, oxygen, carbon, antimony and tin.

<Thickness of Oxygen-Containing Silver-Based Coating Layer>

Although the thickness of the oxygen-containing silver-based coating layer is not particularly limited, it preferably has a minimum thickness in terms of coefficient of friction and electrical conductivity. Also, if the thickness is excessively large, the effect of the oxygen-containing silver-based coating layer is saturated and a material cost increases. From the above viewpoint, the thickness of the oxygen-containing silver-based coating layer is preferably 0.5 to 45 μm, more preferably 0.5 to 35 μm, even more preferably 1 to 20 μm.

<<Underlying Layer>>

An underlying layer may be formed between the base material and the oxygen-containing silver-based coating layer for various purposes. Constituent metals of the underlying layer include Cu, Ni and Ag. For example, for the purpose of preventing copper in the base material from diffusing to the surface of the oxygen-containing silver-based coating layer and deteriorating heat resistance, it is preferable to form an underlying layer comprising Ni. When the base material is a copper alloy containing zinc such as brass and it is intended to prevent the diffusion of zinc in the base material to the surface of the oxygen-containing silver-based coating layer, it is preferable to form an underlying layer comprising Cu. For the purpose of improving the adhesion of the oxygen-containing silver-based coating layer to the base material, it is preferable to form an underlying layer comprising Ag. Although the thickness of the underlaying layer is not particularly limited, it is preferably 0.1 to 2 μm, more preferably 0.1 to 1.5 μm, from a viewpoint of its function and cost.

Further, the terminal of electrical and electronic parts often comprises Sn-plated or reflow Sn-plated material including Cu or Ni underlaying layer. Also in the present invention, such an underlying layer may be formed. That is, in the present invention, a layer comprising each of Cu, Ni, and Ag or a layer of combination of them (laminated structure) may be provided as a base for the oxygen-containing silver-based coating layer. Further, for example, when the composite material of the present invention is used for terminals, the oxygen-containing silver-based coating layer defined in the present invention may be formed on a connecting portion of the base material to be connected to a mating terminal (the underlying layer may or may not be formed), or a different layer may be formed depending on a location, such as forming reflow Sn plating instead of forming the oxygen-containing silver-based coating layer on a caulked portion that is caulked and connected to an electric wire.

<<Coefficient of Friction>>

The composite material of the present invention has a low coefficient of friction because the oxygen-containing silver-based coating layer has oxygen in the vicinity of its surface. Specifically, the coefficient of friction (average F/5N of sliding load) measured under conditions described in examples below is preferably 0.25 or less, more preferably 0.05 to 0.17, and still more preferably 0.05 to 0.14.

<<Electrical Resistance>>

The composite material of the present invention has excellent conductivity equivalent to that of a conventional silver-plated material. Specifically, a contact resistance value measured by the method of examples described later is 10 mΩ or less, preferably 5 mΩ or less, and more preferably 0.05 to 2 mΩ.

[Terminal]

Since the coefficient of friction of the composite material of the present invention is very low, the composite material is suitable as a constituent material of terminals, particularly terminals in electrical contact parts, such as connectors and switches, that slide during use.

The terminal can be formed into a predetermined shape by subjecting the composite material of the present invention to press molding such as punching, bending, and cutting. The terminal may also be obtained by forming the oxygen-containing silver-based coating layer on a base material comprising copper or a copper alloy after performing the above press molding. The terminal may also be obtained by subjecting the surface (or part of the surface) of the coating layer containing silver to plasma treatment in the presence of oxygen, after performing the above press molding to the laminated material that is the material in the method for manufacturing the composite material of the present invention described later. Also, the surface (or part of the surface) of the coating layer may be subjected to the above plasma treatment, and then a remaining portion may be press-molded to form a terminal, after performing part of the above-described press molding to the laminated material.

The terminal is typically a set of male and female terminals, each having a connecting portion 1 for physical and electrical connection to a mating terminal to be connected, and a connecting portion 2 for connection to an external electronic component, electric wire, or the like. The connecting portions 1 and 2 are typically formed by press molding from one composite material and are electrically connected.

The connecting portion 1 of the male terminal is typically formed in a bar shape (cylindrical shape, polygonal column shape, etc.) such as a pin or tab, or in a convex shape. The connecting portion 1 of the female terminal has an accommodating portion formed in a shape to accommodate the connecting portion 1 of the male terminal, and a fixing portion therein for fixing the connecting portion 1 of the mated male terminal in the connecting portion 1 of the female terminal to energize therebetween. Examples of the shape of the accommodating portion include a cylindrical shape and a box-like (rectangular parallelepiped) shape. Further, specific examples of fixing means in the fixing portion include springs and screws. Since the fixing means is energized by contacting the male terminal, it must be highly conductive, and may comprise the same material as the material used for the composite material of the present invention. Alternatively, the fixing portion of the connecting portion 1 of the female terminal may be, for example, a separate spring separated from the accommodating portion, and the fixing portion may be installed in the accommodating portion when connecting the terminal.

Further, for example, when connected to an electric wire, the connecting portion 2 of the male terminal and female terminal for connecting to an external electronic component etc. is formed in a caulking shape for caulking and fixing the terminal and the conductor comprising copper wire etc., from which the resin of the electric wire has been peeled off. When the connecting portion 2 is soldered to a printed circuit board (PCB), the connecting portion 2 is formed in a bar shape such as a round bar or square bar. In this case, the oxygen-containing silver-based coating layer may not be formed on the connecting portion 2.

[Method for Manufacturing Composite Material]

Next, an embodiment of a method for manufacturing a composite material of the present invention will be described. This method is a method including: applying plasma treatment in the presence of oxygen, to a surface of a coating layer of a laminated material in which the coating layer containing silver is formed on a base material comprising copper or copper alloy, and forming an oxygen-containing silver-based coating layer. Each configuration of the method for manufacturing this composite material will be described hereafter.

<<Base Material>>

The base material is the same as the base material described for the composite material of the present invention, and Cu (copper) and Cu alloy are employed as its constituent materials. The Cu alloy is preferably an alloy comprising Cu, and at least one selected from the group consisting of Si (silicon), Fe (iron), Mg (magnesium), P (phosphorus), Ni (nickel), Sn (tin), Co (cobalt), Zn (zinc), Be (beryllium), Pb (lead), Te (tellurium), Ag (silver), Zr (zirconium), Cr (chromium), Al (aluminum) and Ti (titanium), and inevitable impurities. An amount of Cu in the Cu alloy is preferably 50% by mass, more preferably 85% by mass or more, and still more preferably 92% by mass or more. The amount of Cu is preferably 99.95 mass % or less. Further, in the case of so-called brass in which the copper alloy contains 20% by mass or more of Zn, an amount of Cu is preferably 50% by mass or more, more preferably 55% by mass or more, and still more preferably 60% by mass or more. The amount of Cu is preferably 79% by mass or less.

Although the composite material is preferably used for terminal applications as described above, the base material itself may have a shape for use as a terminal, or it may have a flat shape such as a flat plate shape, and in some cases, a plate-shaped member is subjected to a part of processing such as pressing to form a terminal shape. Regarding a long side and a short side of the plate surface of the flat plate (wherein, both lengths may be the same), the length of the short side is, for example, 10 mm to 300 mm, and the length of the long side is, for example, 15 mm or more. Further, the height of the flat plate is 0.1 to 5 when the length of the short side is 100, and a specific numerical value is, for example, 3 mm or less, and usually 0.1 mm or more.

<<Coating Layer>>

A coating layer containing silver can be formed on the base material by any known method. For example, the coating layer can be formed on the base material by methods such as electroplating, vapor deposition, or cladding (metal lamination). Electroplating enables inexpensive formation of a coating layer of a single metal plating or alloy plating, or a coating layer of a composite layer such as an AgC composite layer. Further, the coating layer may be formed on an entire surface of the material, or may be formed on a part of the surface. The electroplating will be described below.

<Electroplating> (Ag Strike Plating)

Before forming the coating layer on the base material by electroplating, it is preferable to form a very thin intermediate layer by Ag strike plating to improve adhesion between the base material and the coating layer. When forming the underlying layer described below on the material, Ag strike plating is performed to the underlaying layer. As a method for performing Ag strike plating, a conventionally known method can be employed without particular limitation as long as the effect of the present invention is not impaired.

(Formation of Underlying Layer)

An underlying layer may be formed on the base material, and a coating layer may be formed on this underlying layer. This underlying layer is similar to that described for the composite material of the present invention. That is, constituent metals of the underlying layer include Cu, Ni and Ag. The underlying layer may be a layer comprising Cu, Ni, or Ag, or a layer of combination of them (laminated structure), and the underlying layer may be formed on an entire surface layer of the base material or on a part thereof, depending on the application of the composite material to be manufactured. The method for forming the underlying layer is not particularly limited, and it can be formed by electroplating the base material by a known method, using an underplating solution containing ions of the constituent metal.

(Electroplating)

By electroplating the above-described base material in a specific electroplating solution, the coating layer containing silver is formed on the base material. The electroplating solution contains silver ions and may contain other metal ions depending on the composition of the coating layer to be formed. The concentration of silver in the electroplating solution is preferably from 5 to 150 g/L, more preferably from 10 to 120 g/L, from a viewpoint of a speed of forming the coating layer and suppression of uneven appearance.

Further, when forming the composite layer such as an AgC composite layer, the electroplating solution also contains carbon particles. The carbon particles are similar to those described for the composite material of the present invention. A volume-based cumulative 50% particle size (D50) measured by a laser diffraction/scattering particle size distribution analyzer is preferably 0.5 to 15 μm, more preferably 1 to 10 μm, from a viewpoint of ease of entanglement in the electroplating film. The shape of the carbon particles is not particularly limited, and may be substantially spherical, scale-shaped, or amorphous, and the scale-like shape is preferable. Preferably, the carbon particles are graphite particles. Further, it is preferable to remove a lipophilic organic matter adsorbed on the surface of the carbon particles by oxidizing the carbon particles. From a viewpoint of the wear resistance and heat resistance of the composite material and since there is a limit to the amount of carbon particles that can be introduced into the coating layer, an amount of the carbon particles described above in the electroplating solution is preferably 10 to 100 g/L, more preferably 15 to 90 g/L.

The electroplating solution preferably contains a complexing agent. The complexing agent complexes silver ions (and other metal ions, if present) in the electroplating solution to increase its ionic stability. Due to such an action, solubility of silver and other metals increases in the solvent constituting the plating solution. Examples of the complexing agents include C1-C12 alkylsulfonic acid, C1-C12 alkanolsulfonic acid and hydroxyarylsulfonic acid. Specific examples of these compounds include methanesulfonic acid, 2-propanolsulfonic acid and phenolsulfonic acid. An amount of the complexing agent in the electroplating solution is preferably 30 to 200 g/L, more preferably 50 to 120 g/L, from a viewpoint of stabilizing silver ions and other metal ions.

As other additives, the electroplating solution may contain a brightener, a curing agent, and a conductivity salt. Examples of the curing agent include carbon sulfide compounds (e.g., carbon disulfide), inorganic sulfur compounds (e.g., sodium thiosulfate), organic compounds (sulfonates), selenium compounds, tellurium compounds, periodic table 4B or 5B group metal, and the like. Potassium hydroxide etc., are exemplified as the conductivity salt.

The solvent constituting the electroplating solution is mainly water. Water is preferable because it dissolves complexed silver ions, dissolves other components contained in the electroplating solution, and has a low environmental impact. Further, a mixed solvent of water and alcohol may be used as the solvent. In the mixed solvent, the proportion of water is preferably 80% by mass or more, more preferably 90% by mass or more, and still more preferably 95% by mass or more.

In the electroplating, a base material to be electroplated is used as a cathode, and for example a silver electrode plate that dissolves to provide silver ions is used as an anode. Electroplating is performed by immersing the cathode and the anode in an electroplating solution (plating bath) and applying an electric current. A current density here is preferably from 0.5 to 10 A/dm$^2$, more preferably from 1 to 8 A/dm$^2$, and even more preferably from 1.5 to 6 A/dm$^2$, from a viewpoint of the speed of forming the coating layer and suppression of uneven appearance. The temperature of the plating bath (plating temperature) is preferably 15 to 50° C., more preferably 20 to 45° C., from a viewpoint of plating production efficiency and prevention of excessive evaporation of the solution. The electroplating time (current application time) can be appropriately adjusted according to a desired thickness of the coating layer, but is typically in a range of 25 to 1800 seconds. Further, a portion to be plated may be an entire surface layer of the base material or a part of the surface layer of the base material, depending on the application of the composite material to be manufactured.

<<Plasma Treatment>>

As described above, plasma treatment is applied to the surface of the coating layer formed on the base material in the presence of oxygen. The surface of the coating layer is the surface of the coating layer that is exposed to the outside and opposite to the surface in contact with the base material (interposing the underlying layer if the underlying layer exists). Oxygen is introduced into the surface of the coating layer by the plasma treatment to form the oxygen-containing silver-based coating layer in the composite material of the present invention described above.

When the coating layer is a composite layer such as an AgC composite layer, ultrasonic cleaning treatment may be applied to the surface of the coating layer prior to plasma treatment. This is to remove carbon particles that simply adhere to the surface and do not contribute to wear resistance, etc., and that may hinder the introduction of oxygen to the surface of the coating layer due to plasma treatment. The ultrasonic cleaning treatment is preferably performed at 20 to 100 kHz for 1 to 300 seconds, more preferably at 25 to 50 kHz for 2 to 270 seconds.

Next, an embodiment of the plasma treatment will be described. Plasma is generated by glow discharge or arc discharge. By injecting and introducing a plasma gas containing oxygen from a plasma gas injection unit into a place where plasma is generated (position A), highly reactive oxygen radicals and oxygen ions (hereinafter collectively referred to as active oxygen) are generated. This active oxygen also constitutes plasma. Then, by arranging the coating layer in an order of the plasma gas injection unit, the position A, and the coating layer, along a plasma gas injection direction, the surface of the coating layer is irradiated with the active oxygen constituting plasma. As a result, it is considered that the active oxygen reacts with silver on the surface of the coating layer to form silver oxide, so that oxygen is present in the vicinity of the surface of the coating layer, that is, the oxygen-containing silver-based coating layer is formed in the composite material of the present invention. As a method for generating plasma, glow discharge is preferable because it can be processed at room temperature and is excellent in safety and cost.

A conventionally known plasma generator can be used without particular limitation, for the plasma treatment in the method for manufacturing a composite material according to the present invention. Examples of commercially available products include a plasma generator (Model 618-920 SP power supply, Capplas 2007A electrode) manufactured by Cresul Co., Ltd.

From a viewpoint of sufficiently generating active oxygen, the plasma gas is preferably a gas containing oxygen, and more preferably a mixed gas containing oxygen with a balance being a non-oxidizing element. Non-oxidizing elements include argon, nitrogen, fluorine, and hydrogen. As the plasma gas, a mixed gas of argon gas and oxygen gas is particularly preferable from a viewpoint of sufficiently generating active oxygen. The proportion of the oxygen gas in the mixed gas is preferably 1 to 20% by volume, more preferably 2 to 10% by volume, from a viewpoint of efficiently introducing oxygen to the surface of the coating layer. When using a mixed gas containing hydrogen, it shall be used outside an explosive limit concentration range of hydrogen, for safety.

A plasma gas flow rate is, for example, 0.3 to 10 L/min, preferably 0.5 to 5 L/min. Further, an amount of the active oxygen irradiated per unit area of the base material by plasma treatment is important in the introduction of oxygen to the surface of the coating layer, and this amount of the active oxygen is determined using the amount of oxygen gas in the plasma gas as an index. According to the present invention, from a viewpoint of introduction of oxygen to the surface of the coating layer and cost, the amount of oxygen gas injected per unit area of the base material is preferably 0.05 to 3 mL/cm$^2$, more preferably 0.15 to 2.7 mL/cm$^2$, and even more preferably 0.8 to 2.5 mL/cm$^2$.

Regarding plasma generation, for example, in the case of glow discharge, the voltage of a plasma power supply in the plasma generator is preferably 3 to 20 kV, and the AC frequency is preferably 5 to 20 KHz.

Further, a distance between the position A where plasma is generated and the coating layer is preferably small from a viewpoint of efficiently introducing oxygen to the surface of the coating layer. On the other hand, in the case of a longer long side of the laminated material, a slight warp may occur, and at this time, it is preferable that a certain distance is ensured so that a warped portion does not come into contact with the electrode. Specifically, the distance is preferably 0.5 to 30 mm, more preferably 0.8 to 10 mm, even more preferably 0.8 to 5 mm. The position A is a tip portion of the electrode close to the coating layer, where plasma is normally generated.

When the composite material is used as a material for sliding contact parts such as terminals, the shape of the laminated material is a flat plate shape, a terminal shape, etc., as described above, and the coating layer may be formed on an entire surface of the base material or may be formed on a part of the surface of the base material. When the laminated material has the flat plate shape, the base material also has a flat plate shape, and as an example, the coating layer is formed on an entire plate surface of the shape (either one or two of the two plate surfaces). It is preferable to uniformly perform the plasma treatment to the coating layer as described above from a viewpoint of reducing variations in the coefficient of friction depending on the location of the coating layer.

For example, when the laminated material has a flat plate shape, using a plasma generator having a plasma generation unit capable of generating plasma with a width equal to or greater than the short side of the flat plate surface, it is preferable to perform plasma treatment by relatively moving the plasma generation unit in a long side direction of the plate surface of the laminated material to perform scanning, while irradiating the coating layer with plasma (active oxygen) from the plasma generation unit.

For example, when the short side is about 10 mm to 200 mm, the plasma generator (Model 618-920 SP power supply, Capplas 2007A electrode) manufactured by Cresul Co., Ltd. can generate plasma with a width equal to or greater than the short side, and can be suitably used. In this embodiment, the plasma gas is preferably a mixed gas of argon gas and oxygen gas, and a flow rate of the argon gas is preferably 1 to 10 L/min, and a flow rate of the oxygen gas is preferably 0.01 to 1 L/min. Further, regarding a relative movement of the electrode with respect to the plate surface of the laminated material, the electrode may be fixed and the laminated material may be moved, or vice versa, or both may be moved. The scanning speed of plasma irradiation with such a relative movement is preferably 100 mm/s or less, more preferably 50 mm/s or less, even more preferably 12 mm/s or less, particularly preferably 7 mm/s or less, and most preferably 0.3 to 3 mm/s, from a viewpoint of productivity of the composite material and introduction of a sufficient amount of oxygen to the surface of the coating layer to manufacture a composite material with a low coefficient of friction. By arranging a plurality of plasma generators and irradiating an entire plate surface of the laminated material with plasma, the scanning speed of each device can be increased accordingly.

EXAMPLE

Examples of the composite material and the method for manufacturing the same according to the present invention will be described in detail hereafter.

<Preparation of Carbon Particles>

80 g of scale-shaped graphite particles (PAG-3000 manufactured by Nippon Graphite Industry Co., Ltd.) having an average particle diameter of 5 μm as carbon particles were added to 1.4 L of pure water, and a mixed solution was heated to 50° C. while stirring. The average particle size was measured using a laser diffraction/scattering particle size distribution analyzer (MT3300 (LOW-WET MT3000II Mode) manufactured by Microtrac Bell Co., Ltd.), and it was a particle size with a volume-based cumulative value of 50%. Next, after gradually dropping 0.6 L of a 0.1 mol/L potassium persulfate aqueous solution as an oxidizing agent into this mixed solution, the mixed solution was stirred for 2 hours to perform an oxidation treatment, then, was filtered with filter paper, and an obtained solid matter was washed with water.

For the carbon particles before and after this oxidation treatment, analysis of a gas generated by heating at 300° C., using a purge-and-trap gas chromatograph-mass spectrometer (equipment combining JHS-100 manufactured by Japan Analytical Industry Co., Ltd. as a thermal desorption device and GCMS QP-5050A manufactured by Shimadzu Corporation as a gas chromatograph mass spectrometer) revealed that lipophilic aliphatic hydrocarbons such as nonane, decane, and 3-methyl-2-heptene attached to the carbon particles and lipophilic aromatic hydrocarbons such as xylene were removed by the above oxidation treatment.

Example 1 Silver Strike Plating

A plate material (NB-109EH manufactured by DOWA Metaltech Co., Ltd.) comprising a Cu—Ni—Sn—P alloy (copper alloy plate containing 1.0% by mass of Ni, 0.9% by mass of Sn, and 0.05% by mass of P with a balance being Cu and inevitable impurities) with a length of 5.0 cm, a width of 5.0 cm, and a thickness of 0.2 mm was prepared. Using this plate material as a base material, electroplating (silver strike plating) was performed for 150 seconds at a current density of 5 A/dm$^2$, with the above base material as a cathode, and an iridium oxide mesh electrode plate as an anode, the iridium oxide mesh electrode plate being the plate in which a titanium mesh material is coated with iridium oxide, in a 25° C. sulfonic acid-based silver strike plating solution containing methanesulfonic acid as a complexing agent (dyne Silver GPE-ST manufactured by Daiwa Kasei Co., Ltd., silver concentration 3 g/L, methanesulfonic acid concentration 42 g/L). Silver strike plating was applied to an entire surface layer of the base material. The thickness of the formed strike plating film was measured with a fluorescent X-ray film thickness meter (FT110A manufactured by Hitachi High-Tech Science Co., Ltd.) and found to be 0.20 μm.

<AgC Plating>

The oxidized carbon particles (graphite particles) were added to a sulfonic acid-based silver plating solution (Dyne Silver GPE-HB manufactured by Daiwa Kasei Co., Ltd., the solvent is water and isopropanol) containing methanesulfonic acid as a complexing agent and having a silver concentration of 30 g/L and a methanesulfonic acid concentration of 60 g/L, to prepare a carbon particle-containing sulfonic acid-based silver plating solution containing carbon particles with a concentration of 50 g/L, silver with a concentration of 30 g/L, and methanesulfonic acid with a concentration of 60 g/L.

Next, electroplating was performed at a temperature of 25° C. and a current density of 3 A/dm$^2$ for 210 seconds, with the above silver strike-plated material as a cathode and the silver electrode plate as an anode, in the above carbon particle-containing sulfonic acid-based silver plating solution, while stirring at 400 rpm with a stirrer, and a laminated material was obtained in which a coating layer (AgC composite layer) containing carbon particles in a silver layer was formed on the base material. The coating layer was formed on an entire surface layer of the base material.

<Ultrasonic Cleaning Treatment>

For the surface of the coating layer of the obtained laminated material, ultrasonic cleaning treatment was performed for 4 minutes at 28 kHz, using an ultrasonic cleaner (AS ONE VS-100III, output 100 W, tank internal dimensions: length 140 mm×width 240 mm×depth 100 mm, used liquid was pure water, water temperature was 20° C.).

<Plasma Treatment>

For the surface of the coating layer of the laminated material obtained by ultrasonic cleaning, using a plasma generator (Model 618-920 SP power supply manufactured by Cresul Co., Ltd., Capplas 2007A electrode, capable of generating plasma with a width of 5.0 cm or more), a voltage was applied to the electrode at a power supply voltage of 11.8 kV and a frequency of 10 kHz, to generate glow discharge plasma under conditions of using a plasma gas that is a mixed gas of Ar with a flow rate of 3.0 L/min and $O_2$ with a flow rate of 0.1 L/min, and plasma treatment was performed at a distance of 1 mm between the surface of the coating layer of the laminated material and the tip of the electrode (where plasma was generated) and at a scanning speed of 1 mm/s, and an oxygen-containing silver-based coating layer was formed from the coating layer.

At this time, by moving the laminated material while fixing the electrode, the electrode was scanned once from one end to the other end of the laminated material. Thus, the plasma treatment was ended. Here, the electrode started scanning from a remote position not above the laminate and passed completely over the laminate. Further, plasma gas was injected downward from an upper part of the glow discharge, and oxygen in the plasma gas became radicals or the like at a place where the glow discharge occurred, and the surface of the coating layer directly below was irradiated. Thus, a composite material was obtained in which an oxygen-containing silver-based coating layer was formed on the base material.

An amount of oxygen gas injected per unit area of the base material was calculated to be 1.1 mL/cm$^2$ from a plasma gas flow rate, an electrode size of the plasma generator, dimensions of the laminated material and a scanning speed.

The composite material obtained in example 1 was evaluated as follows.

<Thickness of Oxygen-Containing Silver-Based Coating Layer>

When the thickness of the oxygen-containing silver-based coating layer of the composite material (a circular area with a diameter of 0.2 mm in the center of a 5.0 cm×5.0 cm plane) was measured with a fluorescent X-ray film thickness gauge (FT110A manufactured by Hitachi High-Tech Science Co., Ltd.), it was found to be 3.0 μm. It is difficult to detect C and O elements of carbon particles with a fluorescent X-ray film thickness meter, so the thickness is obtained by detecting the Ag element, and in this example, the thickness obtained by this method is regarded as the thickness of the oxygen-containing silver-based coating layer.

<Amount of Elements Constituting Oxygen-Containing Silver-Based Coating Layer>

The surface of the oxygen-containing silver-based coating layer was observed using a desktop microscope (TM4000 Plus manufactured by Hitachi High-Technologies Corporation), which is an electron microscope, at an acceleration voltage of 15 kV and a magnification of 1000 times, and in this observation area (1 field of view), EDS analysis was performed using an energy dispersive X-ray spectrometer (AztecOne manufactured by Oxford Instruments Co., Ltd. (Analysis software is AZtecOne 3.3 SP2)) attached to the desktop microscope. The result revealed that O element, Ag element and C element were detected. The O content was 6.6% by mass, the Ag content was 86.5% by mass, and the C content was 6.9% by mass, with respect to 100% by mass of a total amount of all detected elements.

<Measurement of Coefficient of Friction>

The same Cu—Ni—Sn—P alloy plate material as used in example 1 was subjected to indentation to extrude into a hemispherical shape with an inner diameter of 1.0 mm, and a protruding surface of this alloy plate material (the surface pressed against a plate test piece below) was subjected to the same plating treatment (AgSb plating) as in comparative example 2 described later, and an indented test piece was obtained.

On the other hand, using the plate-like composite material obtained in example 1 as a plate test piece, and using a sliding wear tester (CRS-G2050-DWA manufactured by Yamazaki Seiki Laboratory Co., Ltd.), the indented test piece was slid over the surface of the oxygen-containing silver-based coating layer of this plate test piece at a sliding speed of 0.4 mm/sec while pressing the indented test piece against the plate test piece with a constant load (5 N) so that the surface of the oxygen-containing silver-based coating layer of the plate test piece was in contact with the convex portion of the indented test piece, and the sliding load was measured from the start of sliding to a sliding distance of 5 mm. Then, the coefficient of friction (average F/5N of sliding load) was obtained by averaging sliding load data over a sliding distance of 2 mm to 3 mm. As a result, the coefficient of friction was found to be 0.11.

<Measurement of Contact Resistance>

The plate test piece and the indented test piece were placed in the sliding wear tester used to measure the coefficient of friction, and the contact resistance was measured by a four-probe method when the convex portion of the indented test piece was pressed against the oxygen-containing silver-based coating layer of the plate test piece with a constant load (5 N). As a result, the contact resistance value was found to be 0.7 mΩ.

Example 2

With the same material as in example 1 as a cathode and the Ni electrode plate as an anode, electroplating (Ni plating) was performed for 135 seconds, while stirring at a liquid temperature of 55° C. and a current density of 4 A/dm$^2$, in a nickel plating bath (aqueous solution) containing nickel sulfamate with a concentration of 342 g/L (Ni concentration of 80 g/L) and boric acid with a concentration of 45 g/L, and a Ni film (Ni underlying layer) with a thickness of 1.0 μm was formed on the base material. The Ni film was formed on an entire surface layer of the base material.

A composite material was produced in the same manner as in example 1, except that Ag strike plating was applied to the base material on which the Ni underlying layer was formed and the scanning speed of the electrode of the plasma generator in the plasma treatment was 5 mm/s.

As in example 1, for the obtained composite material, the thickness of the oxygen-containing silver-based coating layer, the amount of constituent elements, the coefficient of friction, and the contact resistance were evaluated. The evaluation results are summarized in Table 1 below.

Example 3

A composite material was produced in the same manner as in example 1, except that the scanning speed of the electrode of the plasma generator in the plasma treatment was 10 mm/s.

As in example 1, for the obtained composite material, the thickness of the oxygen-containing silver-based coating layer, the amount of constituent elements, the coefficient of friction, and the contact resistance were evaluated. The evaluation results are summarized in Table 1 below.

Example 4 Ag Strike Plating

Using a base material similar to that of example 1, and with this material as a cathode, and a titanium-platinum mesh electrode plate as an anode, the titanium-platinum mesh electrode plate being the plate in which a titanium mesh material is platinized, electroplating (Ag strike plating) was performed for 30 seconds at a current density of 5 A/dm$^2$, in a cyan-based Ag strike plating solution containing a cyanide compound as a complexing agent (constructed bath from individual general reagents, silver cyanide concentration was 3 g/L, potassium cyanide concentration was 90 g/L, and solvent was water).

<AgSb Plating>

A cyan Ag—Sb alloy plating solution (solvent: water) containing a cyanide compound as a complexing agent and having a silver concentration of 60 g/L and an antimony (Sb) concentration of 2.5 g/L was prepared. The cyan-based Ag—Sb alloy plating solution contains 10% by mass of silver cyanide, 30% by mass of sodium cyanide, and Nissin Bright N (manufactured by Nisshin & Co., Ltd.), and the concentration of Nissin Bright N in the plating solution is 50 mL/L. Nisshin Bright N contains selenium dioxide and diantimony trioxide, and has a selenium dioxide concentration of 0.01% by mass and a diantimony trioxide concentration of 6% by mass.

Next, with the above Ag strike-plated material as a cathode and the silver electrode plate as an anode, electroplating was performed at a temperature of 18° C. and a current density of 3 A/dm$^2$ for 530 seconds, while stirring at 400 rpm with a stirrer, in the above cyan-based Ag—Sb alloy plating solution, and an Ag—Sb alloy plating layer (AgSb alloy layer) was formed on the base material, and the same plasma treatment as in example 1 was performed to obtain a composite material. For the obtained composite material, the thickness of the coating layer, the amount of constituent elements, and the coefficient of friction were evaluated in the same manner as in example 1. The evaluation results are summarized in Table 1 below.

Example 5 Silver Strike Plating

Electroplating (silver strike plating) was performed to the base material in the same manner as in example 1.

<Ag Plating>

A sulfonic acid-based silver plating solution (Dyne Silver GPE-HB manufactured by Daiwa Kasei Co., Ltd., the solvent was water and isopropanol) containing methanesulfonic acid as a complexing agent and having a silver concentration of 30 g/L and a methanesulfonic acid concentration of 60 g/L was prepared.

Next, with the above silver strike-plated material as a cathode and the silver electrode plate as an anode, electroplating was performed for 210 seconds at a temperature of 25° C. and a current density of 3 A/dm$^2$, while stirring at 400 rpm with a stirrer, in the above sulfonic acid-based silver plating solution to form a coating layer (Ag layer) on the base material. Then, the same plasma treatment as in example 1 was performed to obtain a composite material. For the obtained composite material, the thickness of the coating layer, the amount of constituent elements, the coefficient of friction, and the contact resistance were evaluated in the same manner as in example 1. The evaluation results are summarized in Table 1 below.

Comparative Example 1

A composite material was produced in the same manner as in example 1, except that the plasma treatment was not performed. For the obtained composite material, the thickness of the coating layer, the amount of the constituent elements, the measurement of the coefficient of friction, and the measurement of the contact resistance were evaluated in the same manner as in example 1. The evaluation results are summarized in Table 1 below.

Comparative Example 2

A composite material was manufactured in the same manner as in example 4, except that the plasma treatment was not performed. For the obtained composite material, the thickness of the coating layer, the amount of the constituent elements, the measurement of the coefficient of friction, and the measurement of the contact resistance were evaluated in the same manner as in example 1. The evaluation results are summarized in Table 1 below.

Comparative Example 3

A composite material was produced in the same manner as in example 5, except that the plasma treatment was not performed. For the obtained composite material, the thickness of the coating layer, the amount of the constituent elements, the measurement of the coefficient of friction, and the measurement of the contact resistance were evaluated in the same manner as in example 1. The evaluation results are summarized in Table 1 below.

The evaluation results of the above examples and comparative examples and the plasma treatment conditions are summarized in Table 1 below.

TABLE 1

| | Structure of coating layer | | Plasma treatment | | | | | | | | | | |
|---|---|---|---|---|---|---|---|---|---|---|---|---|---|
| | Underlying layer (thickness) | Silver-based coating layer (thickness) | Conducted or not conducted | Scanning speed mm/s | Injected oxygen gas amount mL/cm$^2$ | Amount of constituent element (wt %) Ag | O | C | Sb | Sn | Total | Coefficient of friction (sliding load: 5N) | Contact resistance (load: 5N) mΩ |
| Example 1 | None | AgC layer (3 μm) | Conducted | 1 | 1.10 | 86.5 | 6.6 | 6.9 | 0 | 0 | 100 | 0.11 | 0.7 |
| Example 2 | Ni (1 μm) | AgC layer (3 μm) | Conducted | 5 | 0.22 | 86.8 | 1.8 | 11.6 | 0 | 0 | 100 | 0.17 | 0.6 |
| Example 3 | None | AgC layer (3 μm) | Conducted | 10 | 0.11 | 90.2 | 1.5 | 8.3 | 0 | 0 | 100 | 0.20 | 0.6 |
| Exemple 4 | None | AgSb layer (22 μm) | Conducted | 1 | 1.10 | 93.4 | 5.3 | 0 | 1.3 | 0 | 100 | 0.16 | — |
| Example 5 | None | Ag layer (3 μm) | Conducted | 1 | 1.10 | 98.1 | 1.9 | 0 | 0 | 0 | 100 | 0.20 | 4.4 |
| Com. Ex. 1 | None | AgC layer (3 μm) | Not conducted | — | — | 92.4 | 0 | 7.6 | 0 | 0 | 100 | 0.24 | 0.7 |
| Com. Ex. 2 | None | AgSb layer (22 μm) | Not conducted | — | — | 98.0 | 0 | 0 | 2.0 | 0 | 100 | 0.83 | 0.8 |
| Com. Ex. 3 | None | Ag layer (3 μm) | Not conducted | — | — | 100 | 0 | 0 | 0 | 0 | 100 | 0.89 | 0.7 |

* Com. Ex. = Comparative Example

The invention claimed is:

1. A composite material in which an oxygen-containing silver-based coating layer is formed on a base material, the oxygen-containing silver-based coating layer containing silver and having oxygen present in the vicinity of its surface, and the base material comprising copper or copper alloy;

wherein, as determined by EDS analysis of the surface of the oxygen-containing silver-based coating layer:

a total amount of silver, oxygen, carbon, antimony and tin is 99% by mass or more with respect to 100% by mass of a total amount of all detected elements;

an amount of the oxygen is 1 part by mass or more with respect to 100 parts by mass of the total amount of the silver, the oxygen, the carbon, the antimony and the tin; and a total amount of the silver and the carbon is 93.4 parts by mass or more with respect to 100 parts by mass of the total amount of the silver, the oxygen, the carbon, the antimony, and the tin;

wherein the oxygen-containing silver-based coating layer has a thickness of 0.5 to 45 μm, and the oxygen-containing silver-based coating layer comprises silver oxide.

2. The composite material according to claim 1, which is used for terminal applications.

3. The composite material according to claim 1, wherein the oxygen-containing silver-based coating layer contains carbon particles.

4. The composite material according to claim 1, wherein an underlying layer comprising nickel is formed between the base material and the oxygen-containing silver-based coating layer.

5. The composite material according to claim 1, wherein EDS analysis for the surface of the oxygen-containing silver-based coating layer reveals that an amount of oxygen is 1% by mass or more with respect to 100% by mass of a total amount of all detected elements.

6. The composite material according to claim 1, wherein an amount of the oxygen is 1.1 to 12 parts by mass with respect to 100 parts by mass of the total amount of silver, oxygen, carbon, antimony and tin.

7. A terminal comprising a composite material in which an oxygen-containing silver-based coating layer is formed on a base material, the oxygen-containing silver-based coating layer containing silver and having oxygen present in the vicinity of its surface, and the base material comprising copper or copper alloy;

wherein, as determined by EDS analysis of the surface of the oxygen-containing silver-based coating layer:

a total amount of silver, oxygen, carbon, antimony and tin is 99% by mass or more with respect to 100% by mass of a total amount of all detected elements;

an amount of the oxygen is 1 part by mass or more with respect to 100 parts by mass of the total amount of the silver, the oxygen, the carbon, the antimony and the tin; and a total amount of the silver and the carbon is 93.4 parts by mass or more with respect to 100 parts by mass of the total amount of the silver, the oxygen, the carbon, the antimony, and the tin;

wherein the oxygen-containing silver-based coating layer has a thickness of 0.5 to 45 μm, and the oxygen-containing silver-based coating layer comprises silver oxide.

8. The terminal according to claim 7, wherein the oxygen-containing silver-based coating layer contains carbon particles.

9. The terminal according to claim 7, wherein EDS analysis for the surface of the oxygen-containing silver-based coating layer reveals that an amount of oxygen is 1% by mass or more with respect to 100% by mass of a total amount of all detected elements.

10. A method for manufacturing the composite material of claim 1, comprising:

forming an oxygen-containing silver-based coating layer by applying plasma treatment under a presence of oxygen to a surface of a coating layer in a laminated material in which the coating layer containing silver is formed on a base material comprising copper or copper alloy.

11. The method for manufacturing a composite material according to claim 10, wherein a gas containing oxygen is used as a plasma gas in the plasma treatment.

12. The method for manufacturing a composite material according to claim 11, wherein the plasma gas contains 1 to 20% by volume of oxygen with a balance being a non-oxidizing element.

13. A method for manufacturing a terminal, comprising: molding the composite material according to claim 1 into a terminal shape.

* * * * *